United States Patent [19]

Yanagisawa

[11] Patent Number: 4,649,719

[45] Date of Patent: Mar. 17, 1987

[54] RECEIVER DRYER WITH IMPROVED SEALING STRUCTURE

[75] Inventor: Masahiro Yanagisawa, Isesaki, Japan

[73] Assignee: Sanden Corporation, Gunma, Japan

[21] Appl. No.: 844,319

[22] Filed: Mar. 26, 1986

[30] Foreign Application Priority Data

Mar. 26, 1985 [JP] Japan ..... 60-42277[U]

[51] Int. Cl.[4] ..... F25B 43/00

[52] U.S. Cl. ..... 62/474; 62/509

[58] Field of Search ..... 62/474, 475, 504, 509

[56] References Cited

U.S. PATENT DOCUMENTS 3,785,164 1/1974 Wrenn, Jr. ..... 62/474 X

*Primary Examiner*—Lloyd L. King

*Attorney, Agent, or Firm*—Banner, Birch, McKie and Beckett

[57] ABSTRACT

An improved receiver dryer for a refrigeration circuit is disclosed. The receiver dryer comprises a cylindrical body, a fluid inlet port member and a fluid outlet port member disposed on the cylindrical body, and an induction tube connected to the fluid outlet port member. The fluid outlet port member comprises a connecting member fixed on the cylindrical body, and a port element rotatably supported on the connecting member. The connecting member and the port element form a fluid passage from the cylindrical body to the external refrigeration circuit. The fluid outlet port member is sealed by the clamping action of two opposed surfaces acting on the port element. A sealing mechanism is also placed between the connecting member and the induction tube. Thus, the port member is able to freely rotate, thereby permitting the piping arrangement of the refrigeration circuit to be easily connected and properly sealed.

3 Claims, 3 Drawing Figures

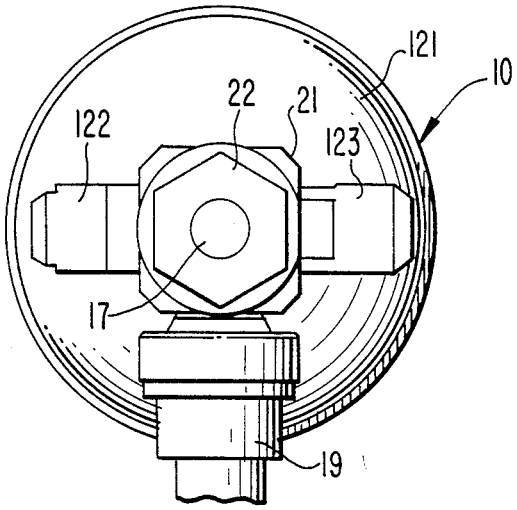
FIG. 1
FIG. 2
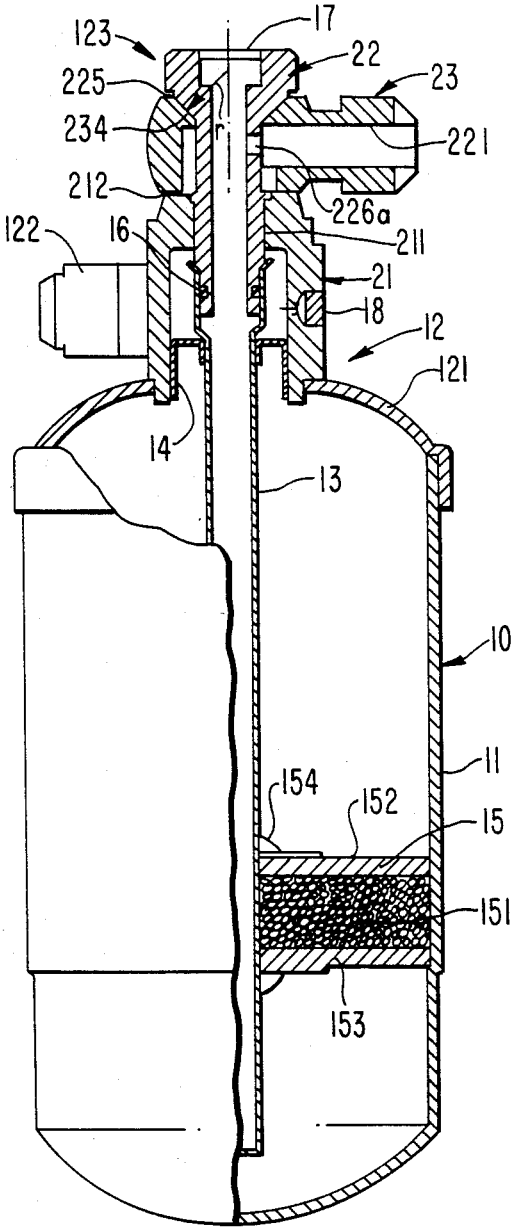
FIG. 3
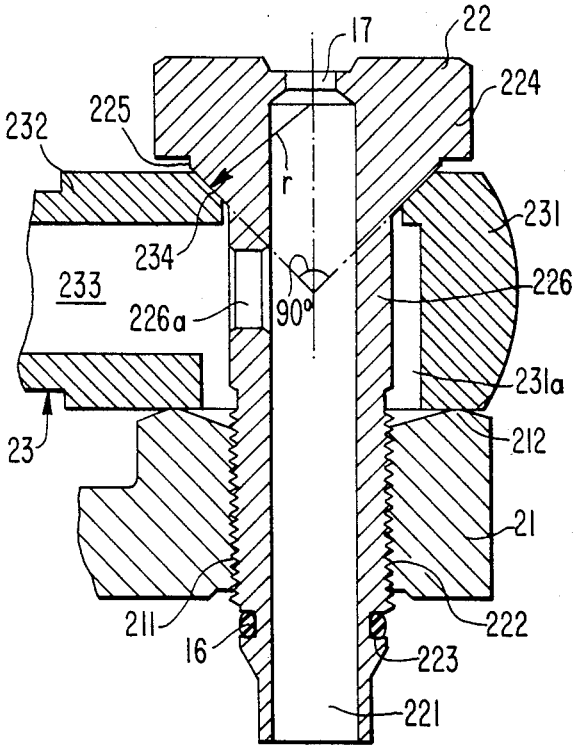

BEST AVAILABLE COPY

RECEIVER DRYER WITH IMPROVED SEALING STRUCTURE

TECHNICAL FIELD

The present invention relates to an improved receiver dryer used in an automobile air conditioning apparatus. More particularly, the present invention relates to an improved sealing structure for a receiver dryer used in an automobile air conditioning apparatus.

BACKGROUND OF THE INVENTION

Receiver dryer devices for use in an automobile air conditioning apparatus are well known in the prior art. The receiver dryer is generally disposed between a condenser and a decompression device of the air conditioning apparatus. The receiver dryer includes a housing having a cylindrical body and a header comprising a fluid inlet port and a fluid outlet port. The header is typically welded on the top of the cylindrical body and is provided with integrally formed fluid ports. Therefore, sealing the receiver dryer to the refrigeration circuit should be accomplished easily. However, because the direction of each fluid port is fixedly determined, the piping of the refrigeration circuit must be carefully arranged to mate with each port. This makes fitting complicated and obtaining a good seal difficult. A large length of pipe is required to seal the receiver dryer to the refrigeration circuit and pressure losses often occur.

One solution to the above problem is to rotatably fasten the fluid inlet port and the fluid outlet port on the header to accommodate a wide range of refrigeration piping configurations. However, the rotatability of the fluid ports impairs their sealing.

SUMMARY OF THE INVENTION

It is an object of this invention to provide an improved receiver dryer for a refrigeration circuit wherein the piping is easily arranged.

It is another object of this invention to provide a reciever dryer for a refrigeration circuit wherein the placement of fluid ports is variable.

It is still another object of this invention to provide a reciver dryer for a refrigeration circuit wherein the sealing of the fluid ports is improved.

It is still another object of this invention to accomplish the above objects with a receiver dryer that is simple in construction and easy to manufacture.

A receiver dryer for a refrigeration circuit in accordance with this invention includes a cylindrical body, a fluid inlet port, and a fluid outlet port. The fluid ports are disposed on the cylindrical body and communicate between the external refrigeration circuit and the interior of the cylindrical body. An induction tube extends within the interior of the cylindrical body and communicates between the cylindrical body and the fluid outlet port. The fluid outlet port is provided with a universal coupling mechanism and comprises a support element fixed on the cylindrical body, and a connector placed on the support element. The connector is provided with a central hollow portion and a radial hole. The fluid outlet port further comprises a port element rotatably supported on the connector. The port element is provided with an axial hollow portion which, together with the central hollow portion and radial hole of the connector, forms a fluid passageway from the interior of the receiver dryer to the refrigeration circuit. The inner end portion of the connector is connected to an upper flange portion of the induction tube. A sealing mechanism is placed between the connector and the induction tube. The fluid inlet port is fixedly placed on the support element of the fluid outlet port.

Various additional advantages and features of novelty which characterize the invention are further pointed out in the claims that follow. However, for a better understanding of the invention and its advantages, reference should be made to the accompanying drawings and the descriptive matter which illustrate and describe the preferred embodiment of the invention.

BRIEF DESCRIPTION OF THE DRAWINGS

FIG. 1 is a plan view of a receiver dryer in accordance with the present invention.

FIG. 2 is a partial cross-sectional view of the receiver dryer of FIG. 1.

FIG. 3 is an enlarged sectional view of the fluid outlet port member of the receiver dryer of FIG. 1.

DETAILED DESCRIPTION OF A PREFERRED EMBODIMENT

Referring to the figures, wherein like numerals indicate like elements, FIGS. 1 and 2 show a receiver dryer according to this invention for use in an automobile air conditioning apparatus. Receiver dryer 10 includes cylindrical body 11 with an upper opening, and header 12 which is disposed and welded on the upper opening. Header 12 comprises cover plate 121 having a central opening, and fluid inlet port member 122 and fluid outlet port member 123 fixed on the central opening.

FIG. 3 illustrates the construction of fluid outlet port member 123. Fluid outlet port member 123 comprises support element 21 welded or brazed on the central opening of cover plate 121. Support element 21 supports connector 22. Connector 22 is provided with central hollow portion 221 extending into the interior of cylindrical body 11. Port element 23 is rotatably fitted on connector 22.

Support element 21 has a U-shaped cross-sectional area. Support element 21 has threaded hole 211 formed axially at its center, and edge ring 212 formed on its outer surface concentric with threaded hole 211. Fluid inlet port member 122 is screwed on the outer peripheral surface of support element 21 through which it communicates with the interior of cylindrical body 11. Connector 22 comprises threaded portion 222 at one end which is screwed into threaded hole 211 of support element 21. Collar portion 224 is formed at the other end of connector 22, and body portion 226 is formed in between. Connector 22 further comprises a connecting portion between collar portion 224 and body element 226. This connecting portion comprises spherical surface 225 which has a radius "r." The surface hardness of edge ring 212 and spherical surface 225 should be hardened by hardness surface treatment or quenching. In addition, sight glass 17 is placed on the outer opening of central hollow portion 221 of connector 22. Induction tube 13 extends into cylindrical body 11. Induction tube 13 is supported on the inner surface of support element 21 through fastening element 14, and is sealed on the inner end of connector 22 as follows. The inner end of connector 22, below threaded portion 222, comprises annular depression 223 and O-ring 16 disposed in annular depression 223; this inner end is inserted into a flange portion of induction tube 13, thereby sealing connector

BEST AVAILABLE COPY 22 to induction tube 13. Filter member 15 is fastened on the lower portion of induction tube 13 through push nut 154. Filter member 15 includes desicant 151 placed between perforated plates 152 and 153.

Port element 23 comprises ring-shaped body portion 231 with cavity 231*a* and port portion 232 which extends radially from the outer peripheral surface of body portion 231. Port portion 232 has hollow portion 233 facing the interior of cavity of 231*a*. Port portion 232 communicates with central hollow portion 221 of connector 22 through radial hole 226*a* in body portion 226. Beveled portion 234 of port element 23 contacts spherical surface 225. Port element 23 is formed of slightly softer material than connector 22, for example, aluminum alloy. In addition, fusable plug 18 is disposed on the peripheral wall of support element 21, and pressure switch 19 is formed in an aperture on the wall of support element 21.

When connector 22 is rotated within support element 21, spherical surface 225 and edge ring 212 engage opposite sides of body portion 226 and clamp it into place. This clamping engagement seals support element 21, connector 22, and port element 23 while enabling the relative positions of fluid inlet port member 122 and fluid outlet port member 123 to be varied by rotating port element 23 of fluid outlet port member 123. Also, O-ring 16 seals fluid outlet port member 123 and induction tube 13. Thus, port element 23 may be freely rotated while adequate sealing of fluid outlet port member 123 and induction tube 13 is maintained. The piping arrangement of the refrigeration circuit can therefore be operated easily while maintaining sufficient sealing by rotating port element 23.

Numerous characteristics and advantages of the invention have been described in detail in the foregoing description with reference to the accompanying drawings. The disclosure, however, is illustrative only and it is to be understood that the invention is not limited to the precise illustrated embodiments. Various changes and modifications may be effected therein by one skilled in the art without departing from the scope or spirit of the invention.

I claim:

1. In a receiver dryer for a refrigeration circuit including a cylindrical body with an upper opening, a cover plate covering the upper opening, fluid inlet and fluid outlet port members mounted on said cover plate in fluid communication with said refrigeration circuit, and an induction tube connected to said fluid outlet port member and extending within said cylindrical body, the improvement comprising: a flange on the upper end of said induction tube; a connecting mechanism forming part of said fluid outlet port member mounted on said cover plate, said connecting mechanism having a hollow tube with a central longitudinal opening extending toward said cylindrical body, one end of said hollow tube extending within said flange of said induction tube, said hollow tube further including a radial hole connected to said central longitudinal opening; a port element forming another part of said fluid outlet port member rotatably mounted on said connecting mechanism adjacent said radial hole, said port element having a hollow portion in fluid communication with the refrigeration circuit and said radial hole of said hollow tube of said connecting mechanism in all rotational positions of said port element to form a fluid passageway from the interior of said cylindrical body to the refrigeration circuit; and sealing means positioned between said hollow tube of said connecting mechanism and said flange of said induction tube for sealing said connecting mechanism and said induction tube.

2. A receiver dryer for a refrigeration circuit as set forth in claim 1 wherein said connecting mechanism has two facing surfaces which are separated by a gap between said facing surfaces for contacting said port element and sealing said fluid outlet port member, said surfaces comprising a spherical portion and an edge portion.

3. A receiver dryer for a refrigeration circuit as set forth in claim 1 wherein said sealing means comprises an O-ring disposed in an annular groove of hollow tube.

* * * * *